US006632253B1

(12) United States Patent
Pettigrew et al.

(10) Patent No.: US 6,632,253 B1
(45) Date of Patent: Oct. 14, 2003

(54) FIBER CLEANING SYSTEM AND METHOD

(76) Inventors: Victoria I. Pettigrew, 18640 Castle Lake Dr., Morgan Hill, CA (US) 95037; Stephen H. Pettigrew, 18640 Castle Lake Dr., Morgan Hill, CA (US) 95037

( * ) Notice: Subject to any disclaimer, the term of this patent is extended or adjusted under 35 U.S.C. 154(b) by 61 days.

(21) Appl. No.: 10/318,735

(22) Filed: Dec. 12, 2002

(51) Int. Cl.[7] ..... D06F 11/26; D06L 11/26

(52) U.S. Cl. ..... 8/137

(58) Field of Search ..... 510/276; 8/137

(56) References Cited

U.S. PATENT DOCUMENTS 4,014,105 A * 3/1977 Furgal et al. ..... 34/12
5,876,462 A * 3/1999 Weller et al. ..... 8/142

* cited by examiner

*Primary Examiner*—Mark Kopec
*Assistant Examiner*—John M. Petruncio
(74) *Attorney, Agent, or Firm*—Silicon Valley IP Group; Kevin J. Zilka

(57) ABSTRACT

A system and method are provided for cleaning fiber. Fiber is first provided for being washed in a solution. Such solution includes ingredients such as stain remover, whitener, brightener, conditioner, and/or odor remover.

11 Claims, 1 Drawing Sheet

FIBER CLEANING SYSTEM AND METHOD

FIELD OF THE INVENTION

The present invention relates to fiber adapted for being spun, and more particularly to cleaning such fiber.

BACKGROUND OF THE INVENTION

In conventional spinning practice, single fibers are spun and used as basic building blocks in the manufacture of the more complex fiber structures. Prior to the spinning process, fibers, which can be of natural or synthetic origin, are processed using various steps including, but not limited to carding, gilling, combing, drawing and roving. Such fibers may be extracted from various animals (i.e. alpacas, llamas, dogs, cats, etc.).

The prepared fiber is then creeled in a spinning frame where it is subjected first to a draft, or attenuation, by which the linear density of the fiber is reduced to a required level, and is then twisted with an amount of twist which depends upon the weight of the fiber and its intended use. The spinning operation is normally carried out on a machine such as a ringframe, a cap-frame or a flyer-frame, in which the rotation of a spindle serves to both insert twist into the fiber and to wind the fiber onto a package carried on the spindle.

Once the fiber has been spun, it can be wound into skeins for storage and transportation purposes. Then, the fiber is ready for being further processed and/or used to create clothing articles and other consumer goods.

At any point of the process, and preferably prior to spinning, the skeins may be washed and dried. This step is of particular importance as fiber can initially include strong odor, significant discoloration, harsh stains, and an unconditioned feel; especially when the fiber is from a natural source (i.e. alpacas, llamas, dogs, cats, etc.). Unfortunately, standard off-the-shelf detergents fail to sufficiently correct the forgoing problems.

DISCLOSURE OF THE INVENTION

A system and method are provided for cleaning fiber. Fiber is first provided for being washed in a solution. Such solution includes ingredients such as stain remover, whitener, brightener, conditioner, and/or odor remover.

DESCRIPTION OF THE PREFERRED EMBODIMENTS

Figure 1:
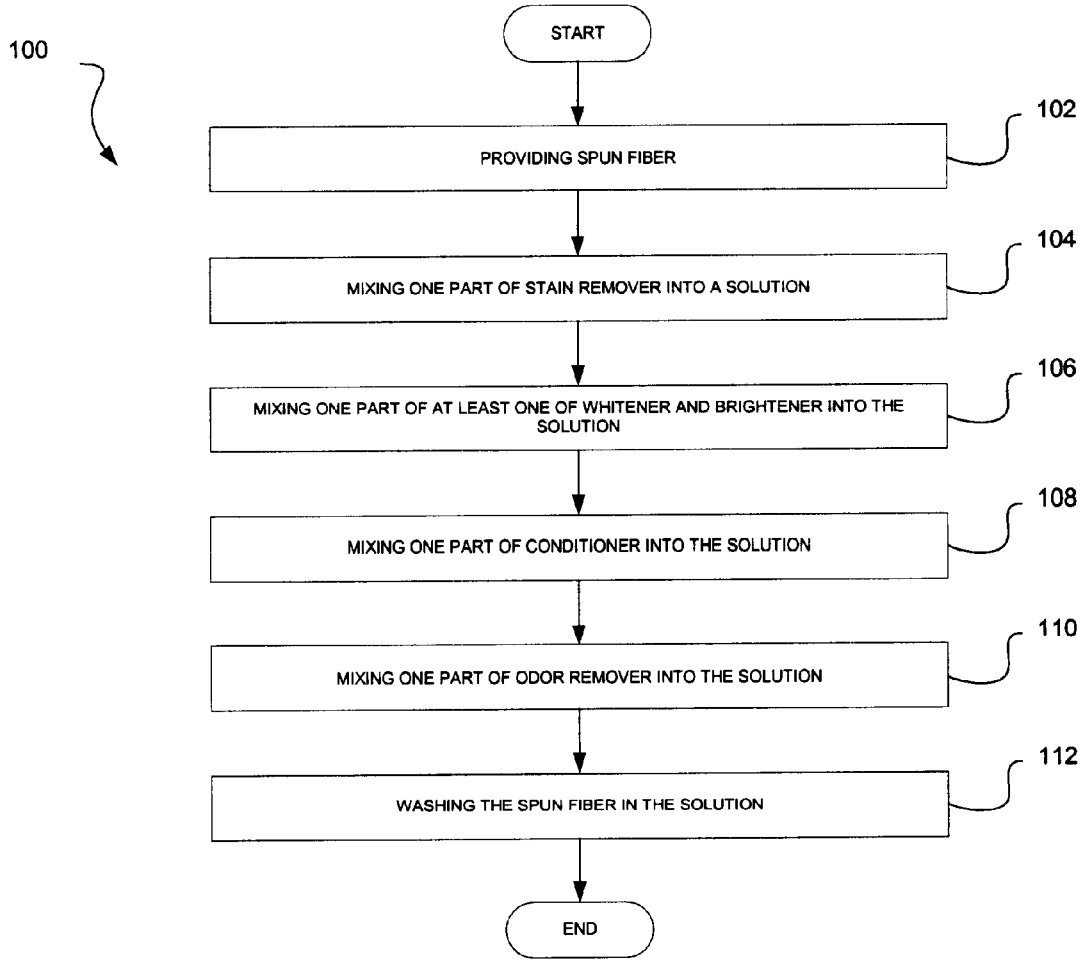
FIG. 1 illustrates a method for cleaning fiber, in accordance with one embodiment.

FIG. 1 illustrates a method 100 for cleaning fiber, in accordance with one embodiment. In the context of the present description, the fiber may include any synthetic fiber or natural fiber (i.e. alpaca, llama, dog, cat, etc.) capable of being spun for use in garments, etc.

In operation 102, fiber is provided to be washed. In one embodiment, the fiber to be washed may take on a raw form existing prior to the spinning process. Of course, the present method 100 may be used to clean fiber at any desired time during the manufacture process.

In order for such fiber to be cleaned appropriately, a solution may be mixed. In particular, in operation 104, one part of stain remover may be mixed into the solution. The stain remover may include any fluid capable of removing stains from fiber. Optionally, the stain remover may include nonionic surfactants and/or conform to STM D-4236. In one exemplary embodiment, the stain remover may include RIT® stain remover.

Next, in operation 106, one part of whitener and/or brightener may be mixed into the solution. The whitener and/or brightener may include any fluid capable of whitening and/or brightening fiber, respectively. Optionally, the whitener and/or brightener may include sodium hydrosulfite, nonionic surfactants, and/or conform to STM D-4236. In one exemplary embodiment, the whitener and/or brightener may include RIT® whitener/brightener.

One part of conditioner is then mixed into the solution, in operation 108. The conditioner may include any fluid capable of conditioning fiber. Optionally, the conditioner may include purified water, stearyl alcohol, cetyl alcohol, behentrimonium chloride, guar hydroxypropyltrimonium chloride, phenyltrimethicone, wheat amino acids, lemon complex (propylene gylcol, lemon extract, fumitory extract, fumaric acid) aloe vera gel, chamomile extract, awapuhi extract, rosemary extract, kelp extract, glycrine, fragrance w/sparent oil, cetyl phosphate, citric acid, methylparaben, propylparaben, methylchloroisothiazolinone (and) methylisothiazolinone, FD&C blue No. 1. In one exemplary embodiment, the conditioner may include KIRKLAND® conditioner.

Thereafter, in operation 110, one part of odor remover is mixed into the solution. The odor remover may include any fluid capable of removing odor from fiber. Optionally, the odor remover may include water, concentrated odor eliminator derived from corn, fragrance. In one exemplary embodiment, the odor remover may include PROCTOR & GAMBLE® FEBREZE® odor remover.

With the solution complete, the fiber may be washed in the solution in operation 112. This may be accomplished by preparing a basin of water by applying an ample amount of the mixture therein and dispersing the same. Then, the fiber may be completely immersed in the basin. The fiber may then be gently massaged with the hands of a user to wash the fiber, while preventing the fiber from interweaving or matting. Then, the fiber may be dried.

By washing the fiber in a water basis including the foregoing mixture of fluids, the fiber is significantly improved in terms of sight, smell, and feel. The fiber is then ready for spinning, etc.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

What is claimed is:

1. A method for cleaning fiber, comprising: providing fiber for being spun;

mixing one part of stain remover into a solution;

mixing one part of at least one of whitener and brightener into the solution;

mixing one part of conditioner into the solution;

mixing one part of odor remover into the solution; and washing the fiber with the solution.

2. A method for cleaning fiber, comprising:

providing fiber;

washing the fiber in a solution including at least two ingredients selected from the group consisting of stain remover, whitener, brightener, conditioner, and odor remover.

3. The method as recited in claim 2, wherein the fiber is washed in a solution including at least three ingredients selected from the group consisting of stain remover, whitener, brightener, conditioner, and odor remover.

4. The method as recited in claim 2, wherein the fiber is washed in a solution including at least four ingredients selected from the group consisting of stain remover, whitener, brightener, conditioner, and odor remover.

5. The method as recited in claim 2, wherein the fiber is washed in a solution including stain remover, whitener, conditioner, and odor remover.

6. The method as recited in claim 2, wherein the fiber is washed in a solution including stain remover, brightener, conditioner, and odor remover.

7. A solution for cleaning fiber, comprising:

a mixture including at least two ingredients selected from the group consisting of stain remover, whitener, brightener, conditioner, and odor remover;

wherein the solution is adapted for being used to cleaning fiber.

8. The solution as recited in claim 7, wherein the mixture includes at least three ingredients selected from the group consisting of stain remover, whitener, brightener, conditioner, and odor remover.

9. The solution as recited in claim 7, wherein the mixture includes at least four ingredients selected from the group consisting of stain remover, whitener, brightener, conditioner, and odor remover.

10. The solution as recited in claim 7, wherein the mixture includes stain remover, whitener, conditioner, and odor remover.

11. The solution as recited in claim 7, wherein the mixture includes stain remover, brightener, conditioner, and odor remover.

* * * * *